US006347496B1

(12) United States Patent
Pinkins

(10) Patent No.: US 6,347,496 B1
(45) Date of Patent: Feb. 19, 2002

(54) WALL REPAIR SYSTEM

(76) Inventor: Robert H. Pinkins, 3978 Brookcrest Cir., Decatur, GA (US) 30032

( * ) Notice: Subject to any disclaimer, the term of this patent is extended or adjusted under 35 U.S.C. 154(b) by 0 days.

(21) Appl. No.: 09/663,172

(22) Filed: Sep. 15, 2000

(51) Int. Cl.[7] ..... E02D 37/00; E04G 23/00
(52) U.S. Cl. ..... 52/514; 52/514.5; 52/366
(58) Field of Search ..... 52/514, 514.5, 52/366, 745.21, 746.1

(56) References Cited

U.S. PATENT DOCUMENTS 4,193,243 A * 3/1980 Tiner ..... 52/514
4,285,183 A * 8/1981 Condit ..... 52/514
4,370,842 A 2/1983 Martin et al.
4,406,107 A 9/1983 Schoonbeck
4,776,906 A * 10/1988 Bernard ..... 52/514 X
4,989,385 A 2/1991 Mc Cullough
5,033,949 A * 7/1991 Jewett ..... 52/514 X
5,034,254 A 7/1991 Cologna et al.
D367,596 S 3/1996 Russell
5,778,624 A 7/1998 Russell
5,925,204 A * 7/1999 Hoffman, Sr. ..... 52/514 X

* cited by examiner

*Primary Examiner*—Beth A. Stephan
*Assistant Examiner*—Brian E. Glessner

(57) ABSTRACT

A wall repair system for repairing holes in drywall panels without furring strips or screws. The wall repair system includes a patch assembly adapted for fitting through a small hole in a dry wall panel, the patch assembly having a front surface with a perimeter edge, the front surface being adapted for coupling to a back surface of a drywall panel after the patch member is fitted through the hole, and a handle member which is couplable to a central portion of the patch assembly for facilitating insertion of the patch assembly through the hole in the drywall panel and subsequent coupling of the perimeter edge of the front surface of the patch assembly to the back surface of the drywall panel.

6 Claims, 4 Drawing Sheets

WALL REPAIR SYSTEM

BACKGROUND OF THE INVENTION

1. Field of the Invention

The present invention relates to hole repairing devices and more particularly pertains to a new wall repair system for repairing holes in drywall panels without furring strips or screws.

2. Description of the Prior Art

The use of hole repairing devices is known in the prior art. More specifically, hole repairing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,778,624; 4,406,107; 4,370,842; 4,989,385; 5,034,254; and U.S. Pat. No. Des. 367,596.

While these devices fulfill their respective, particular objectives and requirements, the aforementioned patents do not disclose a new wall repair system. The inventive device includes a patch assembly adapted for fitting through a small hole in a dry wall panel, the patch assembly having a front surface with a perimeter edge, the front surface being adapted for coupling to a back surface of a drywall panel after said patch member is fitted through the hole, and a handle member which is couplable to a central portion of said patch assembly for facilitating insertion of said patch assembly through the hole in the drywall panel and subsequent coupling of said perimeter edge of said front surface of said patch assembly to the back surface of the drywall panel.

In these respects, the wall repair system according to the present invention substantially departs from the conventional concepts and designs of the prior art, and in so doing provides an apparatus primarily developed for the purpose of repairing holes in drywall panels without furring strips or screws.

SUMMARY OF THE INVENTION

In view of the foregoing disadvantages inherent in the known types of hole repairing devices now present in the prior art, the present invention provides a new wall repair system construction wherein the same can be utilized for repairing holes in drywall panels without furring strips or screws.

The general purpose of the present invention, which will be described subsequently in greater detail, is to provide a new wall repair system apparatus and method which has many of the advantages of the hole repairing devices mentioned heretofore and many novel features that result in a new wall repair system which is not anticipated, rendered obvious, suggested, or even implied by any of the prior art hole repairing devices, either alone or in any combination thereof.

To attain this, the present invention generally comprises a patch assembly adapted for fitting through a small hole in a dry wall panel, the patch assembly having a front surface with a perimeter edge, the front surface being adapted for coupling to a back surface of a drywall panel after said patch member is fitted through the hole, and a handle member which is couplable to a central portion of said patch assembly for facilitating insertion of said patch assembly through the hole in the drywall panel and subsequent coupling of said perimeter edge of said front surface of said patch assembly to the back surface of the drywall panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wall repair system apparatus and method which has many of the advantages of the hole repairing devices mentioned heretofore and many novel features that result in a new wall repair system which is not anticipated, rendered obvious, suggested, or even implied by any of the prior art hole repairing devices, either alone or in any combination thereof.

It is another object of the present invention to provide a new wall repair system which may be easily and efficiently manufactured and marketed.

It is a further object of the present invention to provide a new wall repair system which is of a durable and reliable construction.

An even further object of the present invention is to provide a new wall repair system which is susceptible of a low cost of manufacture with regard to both materials and labor, and which accordingly is then susceptible of low prices of sale to the consuming public, thereby making such wall repair system economically available to the buying public.

Still yet another object of the present invention is to provide a new wall repair system which provides in the apparatuses and methods of the prior art some of the advantages thereof, while simultaneously overcoming some of the disadvantages normally associated therewith.

Still another object of the present invention is to provide a new wall repair system for repairing holes in drywall panels without furring strips or screws.

Yet another object of the present invention is to provide a new wall repair system which includes a patch assembly adapted for fitting through a small hole in a dry wall panel, the patch assembly having a front surface with a perimeter edge, the front surface being adapted for coupling to a back surface of a drywall panel after said patch member is fitted through the hole, and a handle member which is couplable to a central portion of said patch assembly for facilitating insertion of said patch assembly through the hole in the drywall panel and subsequent coupling of said perimeter edge of said front surface of said patch assembly to the back surface of the drywall panel.

Still yet another object of the present invention is to provide a new wall repair system that can be rapidly applied by a single individual.

Even still another object of the present invention is to provide a new wall repair system that provides a broad base for the application of spackling.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
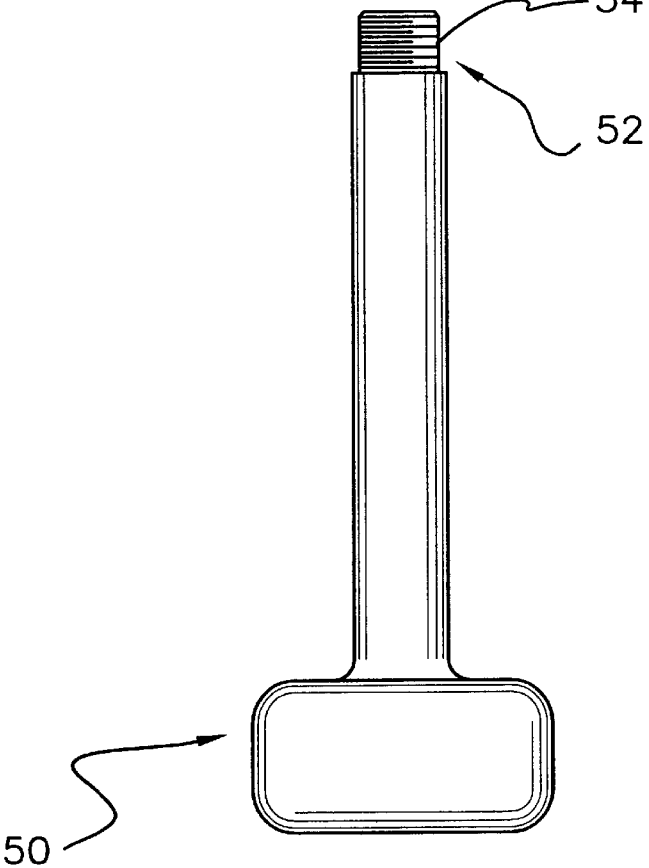
FIG. 2 is a schematic front view of the handle member of the present invention.
Figure 1:
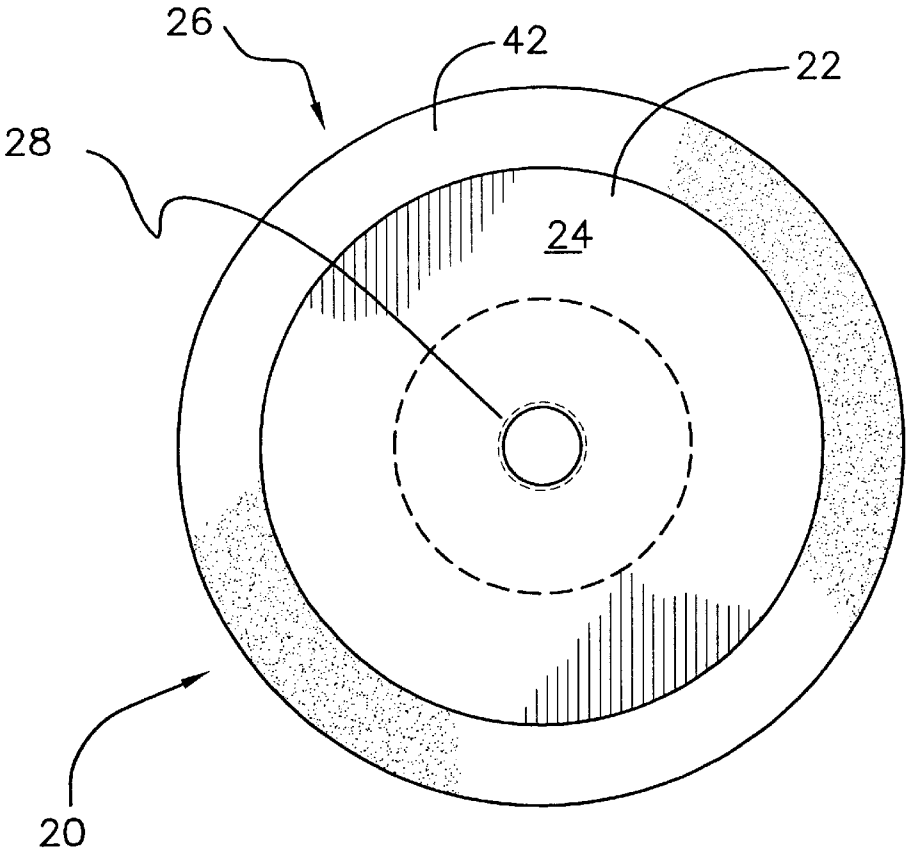
FIG. 1 is a schematic front view of the patch assembly of a new wall repair system according to the present invention.
Figure 3:
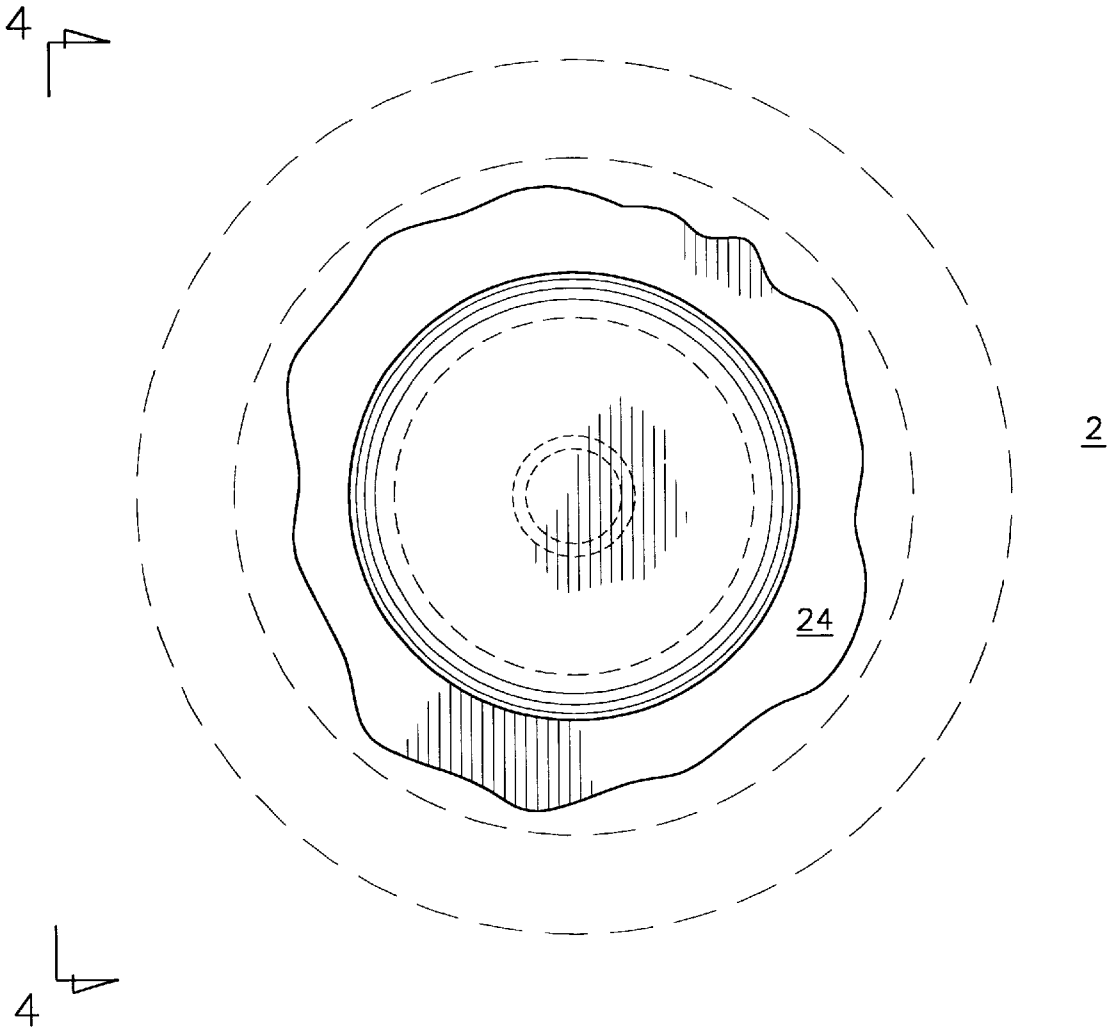
FIG. 3 is a schematic front view of the present invention in use.
Figure 5:
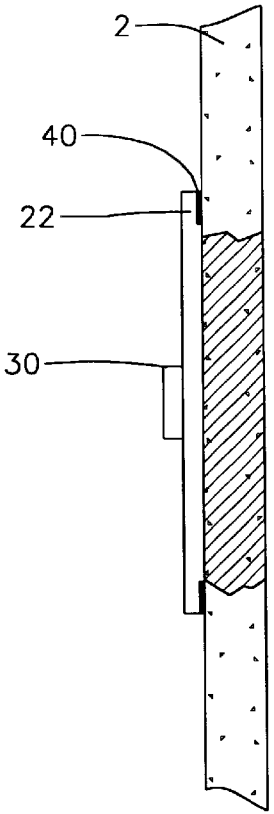
FIG. 5 is a schematic cross-sectional view of the present invention after use.
Figure 4:
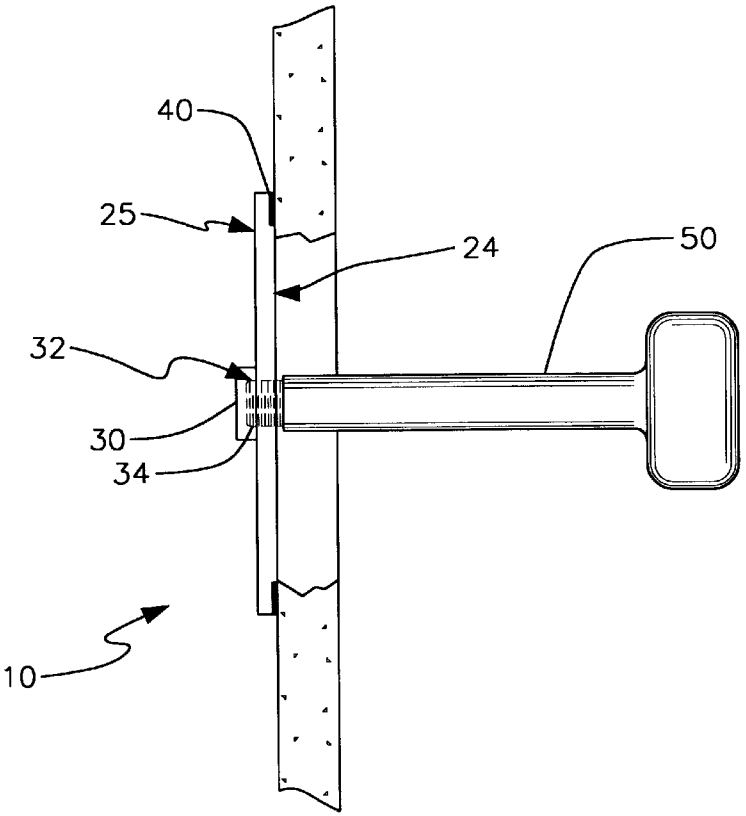
FIG. 4 is a schematic cross-sectional view of the present invention during application of the patch assembly.
Figure 6:
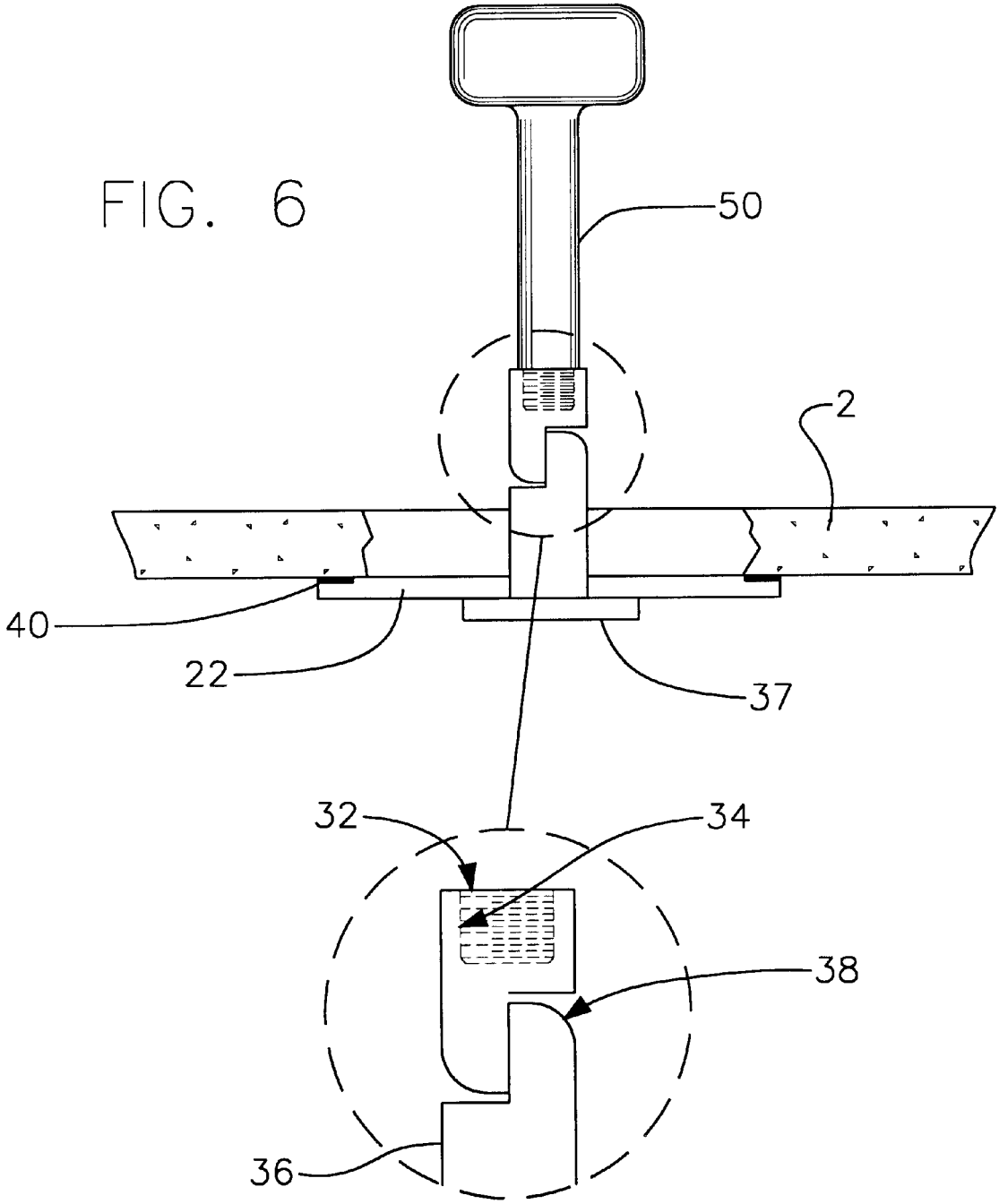
FIG. 6 is a schematic cross-sectional view of and embodiment of the present invention.

With reference now to the drawings, and in particular to FIGS. 1 through 6 thereof, a new wall repair system embodying the principles and concepts of the present invention and generally designated by the reference numeral 10 will be described.

As best illustrated in FIGS. 1 through 6, the wall repair system 10 generally comprises a patch assembly 20 and a handle member 50.

The patch assembly 20 is designed for fitting through a small hole in a dry wall panel 2.

The handle member 50 can be coupled to a central portion of the patch assembly 20 for facilitating insertion of the patch assembly 20 through the hole in the drywall panel 2 and subsequent coupling of a perimeter edge 26 of a front surface 24 of the patch assembly 20 to the back surface of the drywall panel 2.

The patch assembly 20 includes a backing member 22. The backing member 22 is substantially flexible such that the backing member 22 is foldable for insertion through the hole in the drywall panel 2.

The backing member 22 includes the front surface 24. The front surface 24 includes the perimeter edge 26. An adhesive 40 covers the perimeter edge 26 for facilitating coupling the backing member 22 to the back surface of the drywall panel 2.

A protective member 42 covers the adhesive 40 covering the perimeter edge 26 of the backing member 22 such that the adhesive 40 is not damaged or contaminated prior to use of the adhesive 40 for coupling the backing member 22 to the drywall panel 2.

The backing member 22 includes a rear surface 25. A reinforcing member 30 is coupled to a medial portion of the rear surface 25. The reinforcing member 30 is polymeric. The reinforcing member 30 provides substantial rigidity to a central portion of the backing member 22.

The backing member 22 includes an aperture 28, which extends through the backing member 22. The aperture 28 is positioned substantially centrally in the backing member 22.

The reinforcing member 30 includes an aperture 32, which extends through the reinforcing member 30. The aperture 32 is positioned such that the aperture 32 of the reinforcing member 30 is aligned with the aperture 28 of the backing member 22.

The apertures 28,32 are used to receive the handle member 50.

The aperture 32 of the reinforcing member 30 includes an interior perimeter wall 34. The interior perimeter wall 34 is threaded.

The handle member 50 includes a first end 52. The first end 52 includes an outer perimeter wall 54. The outer perimeter wall 54 is threaded such that the handle member 50 is selectively threadedly couplable to the patch assembly 20.

The handle member 50 is for applying a force perpendicular to the front surface 24 of the backing member 22 facilitating coupling of the adhesive 40 to the back surface of the drywall panel 2. Thus the patch assembly 20 is coupled to the drywall panel 2.

In an embodiment, the reinforcing member 30 includes coupling portion 36. The coupling portion 36 is slidable through the aperture 32 of the reinforcing member 30. The coupling portion 36 includes a first end and a second end. The first end includes a flange portion 37 for preventing the coupling portion 36 from sliding beyond a rear surface of the reinforcing member 30 towards the backing member 22. The second end includes a pivotable hinge member 38 and a threaded interior wall 34. The threaded interior wall 34 is for threadedly coupling with the handle member 50. The pivotable hinge member 38 is for pivoting the handle member 50 to a position parallel with a longitudinal axis of the patch assembly 20 as the patch assembly 20 is inserted through the hole in the drywall panel 2.

In use, the patch assembly for inserting through a hole in the drywall panel is provided. The handle member is coupled to the patch assembly. The protective member is removed from the adhesive on the perimeter edge of the front surface of the backing member of the patch assembly. The patch assembly is folded slightly. The patch assembly is inserted through the hole in the drywall panel. The patch assembly is unfolded and aligned with the hole in the drywall panel such that the perimeter edge of the backing member is visually obscured by the drywall panel. The handle member is pulled outward away from the drywall such that a bonding force is applied between the adhesive and a back surface of the drywall panel. The handle is removed from the patch assembly. The hole may now be spackled and repainted.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wall repair system comprising:

a patch assembly adapted for fitting through a small hole in a dry wall panel, said patch assembly having a front surface with a perimeter edge, said front surface being adapted for coupling to a back surface of a drywall panel after said patch member is fitted through the hole;

a handle member couplable to a central portion of said patch assembly for facilitating insertion of said patch assembly through the hole in the drywall panel and subsequent coupling of said perimeter edge of said front surface of said patch assembly to the back surface of the drywall panel;

a reinforcing member;

said patching assembly having a backing member having a rear surface, said reinforcing member being coupled to a medial portion of said rear surface, said reinforcing member being polymeric, said reinforcing member providing substantial rigidity to a central portion of said backing member;

said backing member having an aperture extending therethrough, said aperture being positioned substantially centrally in said backing member;

said reinforcing member having an aperture extending therethrough, said aperture being positioned such that said aperture of said reinforcing member is aligned with said aperture of said backing member;

said apertures being for receiving said handle member;

said reinforcing member having a coupling portion, said coupling portion being slidable through said aperture of said reinforcing member, said coupling portion having a first end and a second end, said first end having a flange portion for preventing said coupling portion from sliding beyond a rear surface of said reinforcing member towards said backing member, said second end having a pivotable hinge member and a threaded interior wall, said threaded interior wall being for threadedly coupling with said handle member, said pivotable hinge member being for pivoting said handle member to a position parallel with a longitudinal axis of said patch assembly as said patch assembly is inserted through the hole in the drywall panel.

2. The wall repair system of claim 1, further comprising:

said backing member being substantially flexible such that said backing member is foldable for insertion through the hole in the drywall panel.

3. The wall repair system of claim 1, further comprising;

an adhesive;

said backing member having a front surface, said front surface having a perimeter edge, said adhesive covering said perimeter edge for facilitating coupling said backing member to the back surface of the drywall panel.

4. The wall repair system of claim 3, further comprising:

a protective member;

said protective member covering said adhesive covering said perimeter edge of said backing member such that said adhesive is not damaged or contaminated prior to use of said adhesive for coupling said backing member to the drywall panel.

5. The wall reinforcing system of claim 1, further comprising:

said aperture of said reinforcing member having an interior perimeter wall, said interior perimeter wall being threaded;

said handle member having a first end, said first end having an outer perimeter wall, said outer perimeter wall being threaded such that said handle member being selectively threadedly couplable to said patch assembly;

said handle assembly being for applying a force perpendicular to a front surface of said backing member facilitating coupling of said adhesive to the back surface of the drywall panel whereby said backing member is coupled to the drywall panel.

6. A wall repair system comprising:

a patch assembly adapted for fitting through a small hole in a dry wall panel, said patch assembly having a front surface with a perimeter edge, said front surface being adapted for coupling to a back surface of a drywall panel after said patch member is fitted through the hole;

a handle member couplable to a central portion of said patch assembly for facilitating insertion of said patch assembly through the hole in the drywall panel and subsequent coupling of said perimeter edge of said front surface of said patch assembly to the back surface of the drywall panel;

said patch assembly having a backing member, said backing member being substantially flexible such that said backing member is foldable for insertion through the hole in the drywall panel;

an adhesive;

said backing member having a front surface, said front surface having a perimeter edge, said adhesive covering said perimeter edge for facilitating coupling said backing member to the back surface of the drywall panel;

a protective member;

said protective member covering said adhesive covering said perimeter edge of said backing member such that said adhesive is not damaged or contaminated prior to use of said adhesive for coupling said backing member to the drywall panel;

a reinforcing member;

said backing member having a rear surface, said reinforcing member being coupled to a medial portion of said rear surface, said reinforcing member being polymeric, said reinforcing member providing substantial rigidity to a central portion of said backing member;

said backing member having an aperture extending therethrough, said aperture being positioned substantially centrally in said backing member;

said reinforcing member having an aperture extending therethrough, said aperture being positioned such that said aperture of said reinforcing member is aligned with said aperture of said backing member;

said apertures being for receiving said handle member;

said aperture of said reinforcing member having an interior perimeter wall, said interior perimeter wall being threaded;

said handle member having a first end, said first end having an outer perimeter wall, said outer perimeter wall being threaded such that said handle member being selectively threadedly couplable to said patch assembly;

said handle assembly being for applying a force perpendicular to a front surface of said backing member facilitating coupling of said adhesive to the back surface of the drywall panel whereby said backing member is coupled to the drywall panel;

said reinforcing member having a coupling portion, said coupling portion being slidable through said aperture of said reinforcing member, said coupling portion having a first end and a second end, said first end having a flange portion for preventing said coupling portion from sliding beyond a rear surface of said reinforcing member towards said backing member, said second end having a pivotable hinge member and a threaded interior wall, said threaded interior wall being for threadedly coupling with said handle member, said pivotable hinge member being for pivoting said handle member to a position parallel with a longitudinal axis of said patch assembly as said patch assembly is inserted through the hole in the drywall panel.

* * * * *